United States Patent [19]

Fekete et al.

[11] Patent Number: 4,457,759

[45] Date of Patent: Jul. 3, 1984

[54] ENVIRONMENT-PROTECTING METHOD FOR THE LIMING OF RAW HIDES

[75] Inventors: Kálmán Fekete; Tamás Karnischer; István Malovecz; István Tuba; Béla Lukasics; Mágdolna Makk née Petrányi; Zoltán Princz; Antal Szabó, all of Budapest, Hungary.

[73] Assignee: Bor- Mubor- es Cipoipari Kutato Intezet, Budapest, Hungary

[21] Appl. No.: 440,222

[22] PCT Filed: Mar. 10, 1982

[86] PCT No.: PCT/HU82/00009

§ 371 Date: Oct. 29, 1872

§ 102(e) Date: Oct. 29, 1982

[87] PCT Pub. No.: WO82/03228

PCT Pub. Date: Sep. 30, 1982

[30] Foreign Application Priority Data

Mar. 12, 1981 [HU] Hungary ..... 616/81

[51] Int. Cl.[3] ..... C14C 1/06; C14C 1/04

[52] U.S. Cl. ..... 8/94.16; 8/94.17

[58] Field of Search ..... 8/94.16, 94.17

[56] References Cited

U.S. PATENT DOCUMENTS

| | | | |
|---|---|---|---|
| 2,157,969 | 5/1939 | Rohm | 8/94.16 |
| 2,179,899 | 11/1939 | Rohm | 8/94.17 |
| 3,574,516 | 4/1971 | Heidmann et al. | 8/94.16 |
| 4,278,432 | 7/1981 | Monsheimer et al. | 8/94.16 |

FOREIGN PATENT DOCUMENTS

| | | | |
|---|---|---|---|
| 2726576 | 12/1978 | Fed. Rep. of Germany | 8/94.16 |
| 921072 | 3/1963 | United Kingdom | 8/94.16 |

*Primary Examiner*—Maria Parrish Tungol
*Attorney, Agent, or Firm*—Keil & Weinkauf

[57] ABSTRACT

The invention relates to an environment-protecting method for the liming of raw hides, wherein, after an optional mechanical degreasing step, the hides are subjected to presoaking, chemical degreasing, washing, alkaline swelling and collapsing, enzymatic unhairing, plucking and liming, and the sulfide ions remaining in the liquor after liming are deactivated. According to the invention the raw hides are treated, prior to liming, with 0.05 to 0.50% by weight of a proteolytic enzyme with an Anson-activity of 1.2 to 1.5 in a bath of a temperature not exceeding 35° C. and a pH value not exceeding 12, thereafter the hides are subjected to hair-destruction liming with a lime liquor containing not more than 2.0% by weight of disodium sulfide and/or sodium hydrogen sulfide, calculated for the weight of the raw hide, and the sulfide ions remaining in the lime liquor are oxidized directly in the liming vessel so that 100% by weight of water and at least 0.04% by weight of manganese sulfate are added to the used lime liquor in the presence of the limed hides, the hides are rotated in the liquor for at least 15 minutes, thereafter up to 1.0% by weight of technical hydrogen peroxide are added, preferably in three portions at intervals of 10 minutes, to the liquor within an additional rotation period not exceeding 150 minutes.

12 Claims, No Drawings

ENVIRONMENT-PROTECTING METHOD FOR THE LIMING OF RAW HIDES

The invention relates to a new, environment-protecting method for the liming and unhairing of raw hides. According to the method of the invention the environmental pollution caused by the various ingredients of technological sewage can be eliminated or at least reduced considerably.

The increase in the production of leather industry involves a similar increase in the amount of chemicals utilized. This results in a significant increase in both the amount and the contamination degree of sewages, leading to serious problems of environmental protection.

It is also known that about 70% of the contaminations arising in the sewages from hide processing originate from the liming-soaking step. Of these contaminating substances, sulfide ions, originating from sodium sulfide utilized to decompose hair keratin, cause the greatest problems. Sulfide ions are poisonous, inhibiting the functions of the bacterium flora of biological sewage treatment plants, and even more, beyond a critical concentration, destroying the bacterium flora completely.

A major part of calcium hydroxide, which is also added to the liming bath, separates as an insoluble substance, which further increases the problems appearing at sewage purification.

Apart from the above substances, dissolution or decomposition products (such as proteins, fats, etc.) originating from the raw hide also contaminate the sewages of the liming procedure.

Thus, some of the contaminating substances which appear in the sewages of liming procedure originate from the processed hides themselves, whereas others arise from the chemicals introduced into the bath in accordance with the technology applied.

The amount and quality of contaminating components originating from the hides themselves are not to be changed, since one of the purposes of hide processing technologies is just the removal of the undesired or superfluous components of the hide. The degree of protein destruction depends on the required quality of the finished leather.

Several attempts have been made to eliminate or reduce the above phenomena detrimental to environment. The presently known so-called environment protecting steeping-liming technologies can be classified into two groups. In the methods belonging to the first group it is suggested to replace sodium sulfide and/or sodium sulfide hydrate as well as calcium hydroxide, utilized in the conventional technologies, partly or completely by other substances less hazardous to the environment [see H. Fritz: The Leather Manufacturer 1979, p. 322 (1979 Oct.)].

In the methods belonging to the second group the once-used baths are replenished and then recycled for repeated use, decreasing thereby the amount of sewage and thus its detrimental effects, too [see B. Schubert: Leder and Häutemarkt, Gerbereiwissenschaft und Praxis 1975, 318 (1975)].

The majority of the methods belonging to the first group aim at the elimination of the use of poisonous sulfide ions or at least at the reduction of their amount. Examples for these methods are the hair-loosening technique based on the use of dimethyl amine, a method developed by American authors a long time ago but utilized in practice scarcely and as a secondary treatment only; the technologies based on the use of enzymes produced by the firm Röhm G [see Grimm, Trabitsch: Revue Technique 1964, 134 (1964); German patent specifications Nos. 2,307,603, 2,404,789 and 2,301,603], furthermore the methods based on the use of organic mercaptans manufactured by the firm BASF, such as Melescal SF [see H. Fritz: The Leather Manufacturer, 1979, 32 (1979 Oct.)].

A common disadvantage of these known methods is that they are either too expensive or they still require the use of a certain amount of sodium sulfide in order to attain a safe unhairing effect or to ensure the required quality of finished leather.

Methods for sewage purification aiming at the partial or total destruction of the sulfide content of sewage have also been described in the literature. Of these methods those based on catalytic oxidation or precipitation with iron sulfate are to be mentioned. These methods require, however, a substantial investment, and their spatial demand is unreasonably high [see M. Aloy, A. Folachier and B. Wulliermet: Technicuir 4, 64–72 (1978)].

The invention aims at the elaboration of a new, environment-protecting method for unhairing hides, which enables one to reduce or eliminate the environment-polluting effects of sewages originating from the liming step by reducing the amount and/or neutralizing the harmful effects of sodium sulfide. A further aim of the invention is to develop an unhairing method which makes the installation or use of expensive and space demanding sewage treatment plants unnecessary. The invention also aims at providing a technically acceptable, economical hide processing technology causing a sulfide contamination below the environmentally tolerable level, applicable even in leather plants which, due to their restricted possibilities for expansion, cannot set up sewage treatment plants.

The invention is based on the recognition that the above requirements can be fulfilled optimally by a process in which as enzymatic hair-loosening step and the removal of the hair is followed by the destruction of the remaining hair utilizing 30–50% of the so far applied amount of sodium sulfide. The sulfide ions appearing in the exhaust liquor are oxidized in the liming apparatus itself, in the presence of the limed hide, by introducing an oxidizing substance in the presence of a catalyst, whereby the environment-polluting effects of the technological exhaust sewage can be reduced.

Based on the above, the invention relates to an environment-protecting method for the liming of raw hides, wherein, after an optional mechanical degreasing step, the hides are subjected to pre-soaking, chemical degreasing, washing, alkaline swelling and collapsing, enzymatic unhairing, plucking and liming, and the sulfide ions remaining in the liquor after liming are deactivated. According to the invention the raw hides are treated, prior to liming, with 0.05 to 0.50% by weight, preferably 0.25% by weight, of a proteolytic enzyme with an Anson-activity of 1.2 to 1.5 in a bath of a temperature not exceeding 35° C. and a pH value not exceeding 12, thereafter the hides are subjected to hair-destruction liming with a lime liquor containing not more than 2.0% by weight of disodium sulfide and/or sodium hydrogen sulfide, calculated for the weight of the raw hide, and the sulfide ions remaining in the lime liquor are oxidized directly in the liming vessel so that 50 to 150% by weight of water and at least 0.04% by weight of manganese sulfate are added to the used lime liquor in the presence of the limed hides, the hides are rotated in the liquor for at least 15 minutes, thereafter up to 1.0% by weight of hydrogen peroxide are added, preferably in three portions at intervals of 10 minutes, to the liquor within an additional rotation period not exceeding 150 minutes, and then the hides are subjected to conventional finishing operations, such as deliming, bating, pickling and tanning.

According to a preferred method of the invention the loosening of hair is facilitated by swelling the hides prior to enzymatic unhairing in a still not-immunizing, slightly alkaline bath, preferably in a 0.1–0.15 molar sodium hydroxide solution at 28° to 35° C., under rotating them for up to 60 minutes.

In a further preferred method of the invention the hides are not subjected to mechanical plucking for unhairing and hair recovery, but the bath is decanted, and the hides are grimped in a drum for 20–60 minutes, preferably for 30 minutes. When a drum, an Y-apparatus or a mixer-type apparatus is applied, one can also proceed by destructing the hair residues, remaining on the hide after unhairing, by adding 0.5 to 2.0% by weight, calculated for the weight of the raw hide, of a 60% technical disodium sulfide and sodium hydrogen sulfide solution to the liquor. When the hides are treated in a lime reel, it is preferred to adjust the disodium sulfide concentration of the lime liquor to the required value by introducing 5–10 g/l, preferably 10 g/l, of a 60% disodium sulfide solution. In another preferred method the sulfide content of the used liquor and the pelt is oxidized after the liming procedure directly in the liming apparatus by introducing 0.1 to 1.0% by weight, preferably 0.5% by weight, calculated for the weight of the hide, of a technical hydrogen peroxide solution. This oxidation is performed preferably in a solution containing 20 to 200 mg/l, preferably 150 mg/l, of manganese sulfate. Manganese sulfate is fed onto the pelts in the used liming bath preferably prior to the introduction of hydrogen peroxide.

The process of the invention is elucidated in detail by the aid of the following non-limiting Examples.

EXAMPLE 1

The raw hides, conserved by salting in a manner known per se, are optionally subjected to mechanical degreasing and then put into a liming drum.

The hides are pre-soaked in 300% by weight of 30° C. water under rotating the drum for 30 minutes, then the soaking liquor is removed. Thereafter, the hides are subjected to main soaking and chemical degreasing by rotating them for 120 minutes in 200% by weight of 30° C. water in the presence of 0.5% by weight of sodium carbonate and 1.0% by weight of fatty alcohol sulfate, then the liquor is removed.

The hides are then washed with 30° C. running water or rotated thrice in 30° C. water.

When the hides become duly sodden upon washing, they are subjected to alkaline swelling so that the hides are rotated for 5 minutes in 200% by weight of 30° C. water in the presence of 0.92% by weight of lime hydrate, thereafter 1.32% by weight of sodium carbonate are added, and rotating is continued for 90 minutes. The liquor is then removed.

Thereafter the drum is filled up with 200% by weight of 30° C. water, 2% by weight of ammonium sulfate are added, and the hides are rotated in the liquor for 60 minutes. Thus the pH of the bath and the hides is adjusted to 9.5–9.7, i.e. to the optimum value of the enzyme utilized.

Then, 0.08 to 0.25% by weight, preferably 0.25% by weight, of an alkaline protease (activity: 1.2–1.5 Anson units) is added to the bath, and the hides are rotated for 5 minutes. 0.1% by weight of sodium chlorite is then added to the bath, the drum is rotated for 240 minutes at a rate of 3 r.p.m., and then the hides are allowed to stand in the bath for 720–1200 minutes, preferably 840 minutes.

Thereafter the hides are subjected to mechanical plucking, and then rinsed with 20° C. water by rotation for 30 minutes. If the plant is not equipped with an unhairing apparatus, one can also proceed by maintaining the hides in the enzymatic bath for additional 1440 minutes, and then rotating them twice for 15 minutes, under removing the hair from the surface of the hides by rubbing. Thereafter the hides are rinsed for 20–30 minutes with 20° C. running water.

The rinsed hides are subjected then to liming. This step is started by rotating the hides for 90 minutes in 30% by weight of 20° C. water in the presence of 1% by weight of a 60% sodium sulfide solution. Thereafter 70% by wight of 20° C. water and 4% by weight of lime hydrate are added, the hides are rotated in the bath for 300 minutes, and then allowed to stand for 720–1440 minutes, preferably 960 minutes. During this period the hides are rotated for 5 minutes in every two hours.

Thereafter 100% by weight of 20° C. water and 0.04% by weight of manganese sulfate are added to the liming bath, and the hides are rotated for 15 minutes. 5% by weight of hydrogen peroxide are introduced in three portions, at intervals of 10 minutes, and the hides are rotated further for 150 minutes. The liquor is removed, and the hides are rinsed with 20° C. running water for 30 minutes under rotating. Thereafter the liquor is removed, and the hides are rotated for 360 minutes in 200% by weight of 22° C. water in the presence of 4% by weight of lime hydrate to effect post-liming. The hides are allowed to stand for 1680 minutes in the bath, and then subjected to deliming, bating, pickling and tanning according to known techniques.

EXAMPLE 2

The raw hides are degreased, soaken and subjected to alkaline swelling as described in Example 1, then the pH of the bath is adjusted to 9.5–9.7. Then, 0.20–0.25% of an alkaline protease (activity: 1.2–1.5 Anson units) and 0.1% of sodium chlorite (a disinfecting agent) are added, and the hides are rotated for 240 minutes. Thereafter the hides are allowed to stand in the liquor for 720 minutes.

On the next day the hides are rotated for 1–2 minutes in every hour, and after this period, lasting for 720 minutes, they are allowed to stand for another 720 minutes. Then the bath is removed and the hides are rotated for 30 minutes without any liquid in order to rub off the hair. The hair accumulated in the drum is removed by washing, and then the hides are treated as described in Example 1.

EXAMPLE 3

The procedures described in Examples 1 and 2 can also be performed in other apparatuses, such as Y-shaped vessels, mixers, lime reels, etc. The technology is basically the same in these cases, only the amount of the bath should be increased or decreased in accordance with the operation of the apparatus selected. The feed differs from that discussed above only when lime reel is applied, since in this instance 5–20 g/l of a 60% sodium sulfide solution are required to destroy the remainder of the hair. The amount of hydrogen peroxide used in the oxidation step should be increased accordingly.

According to our tests when liming is combined with a pre-treatment with porteolytic enzyme, the degree of fibre loosening can be varied at will upon varying the intensity of the enzymatic treatment, which enables a rational leather production for wear purposes.

The enzymatically loosened and then recovered hair is a valuable by-product of the process.

The natural fat content of raw hides, particularly pig hides, is high at the loose topographical sites (necks, abdominal edges, etc.), due particularly to the parallel orientation of the fibres. Since at these places the fat layer protects the hide substance from enzymatic decomposition to some extent, the process has a favourable effect on the topographical uniformity of finished leather.

The enzymatic treatment reduces the swellability of the pelt and increases its tensile strength. Thus in a pilot plant test series a 2–4% increase in surface yield could be attained.

Our test results have also revealed that, due to economical and safety reasons, it is not recommended to increase the intensity of enzymatic pre-treatment up to the complete removal of the hair. It has been observed that there is an exponential relationship between the intensity of the enzymatic treatment (amount of enzyme added, time and temperature of treatment) and the loosening of the hair. Thus it is generally not necessary to attain an effect stronger than that required for the removal of about 90–95% of the total hair. The recovery of the total amount of hair also depends on factors independent from the technology applied (such as the variety and breeding of the animal, the degree of preservation, etc.). A significant advantage of the new method is that, by varying the intensity of the enzymatic treatment, the character of the finished product, particularly its softness and velour appearance, can be influenced without a significant variation in the amount of the recovered hair.

It has also been observed that, under considering the conditions of leather industry, hydrogen peroxide is the most appropriate reactant for performing the oxidation directly in the liming vessel. Taking into account that other oxidizable substances, such as proteins, fats, etc., are also present in the liquor, hydrogen peroxide cannot be used in stoichiometric amounts. Since the reaction is fast, it is preferred to monitor the presence of sulfide ions by lead acetate paper test, and to continue the addition of hydrogen peroxide until sulfide reaction can no longer be observed. The presence of manganese sulfate catalyst promotes the effects of hydrogen peroxide; this can be explained by the composition discussed above of the lime liquor.

It has also been observed that the oxidation step has a favourable influence on the purity of the pelt, since it removes the epidermis residues as well. Such pelts with improved purity can be applied to advantage in the manufacture of aniline coloured and fully grained products.

Summing up, the main advantages of the new method according to the invention are as follows:

By applying the method of the invention, a sewage with a sulfide ion content not exceeding the tolerable limits can be obtained without utilizing separate means for sewage purification.

The process enables one to recover the valuable hair in perfect condition.

Upon pre-treatment with proteolytic enzymes, finished products softer than the usual ones can be obtained, and the intensity of enzymatic treatment can be flexibly adapted to the quality requirements of the finished products.

The surface yield of the finished products obtained in the method of the invention is greater by 2–4% than that of the leathers produced by conventional techniques.

Apart from the reduced sulfide ion content, the chemical oxygen demand and fat content of the sewage are also more favourable, which can be attributed to the recovery of hair and the previous degreasing of the raw hide.

What we claim is:

1. An improved hide unhairing and liming method resulting in an exhaust sewage of reduced hair decomposition products and sulfide ion pollution, said process comprising:

treating hides with a proteolytic enzyme solution to loosen most of the hair present on the hides;

removing the loosened hair from the hides without destroying the hair;

rinsing the hides of enzyme solution;

liming the hides in a sulfide liquor of relatively low strength containing not more than 2.0 percent by weight of the hides of sodium sulfide or sodium hydrogen sulfide, and mixtures thereof; and thereafter adding hydrogen peroxide to the liquor in an amount of 0.25 to 1.0 percent by weight of the hides sufficient to oxidize the sulfide ions present in the liquor.

2. The method of claim 1 wherein following liming of the hides and prior to the addition of hydrogen peroxide, manganese sulfate is added to the sulfide liquor in an amount of about 0.04 percent by weight.

3. The method of claim 1 wherein prior to treating with a proteolytic enzyme solution the hides are swelled in a slightly alkaline bath of sodium hydroxide at 28°–35° C.

4. The method of claim 1 wherein pig hides are treated, prior to liming, with 0.08 to 0.25% by weight of a proteolytic enzyme with an Anson-activity of 1.2–1.5 in a bath of a temperature not exceeding 35° C. and a pH value not exceeding 12, and wherein the hides are subjected to hair-destruction liming with a lime liquor containing not more than 2.0% by weight of disodium sulfide, calculated for the weight of the raw hide, then 100% by weight of water and 0.04% by weight of manganese sulfate are added to the used lime liquor in the presence of the limed hides directly in the liming vessel, the hides are rotated for at least 15 minutes, thereafter up to 0.5% by weight of hydrogen peroxide are added to the liquor within an additional rotation period not exceeding 150 minutes, and then the pig hides are subjected to conventional deliming, bating, pickling and tanning operations.

5. The method of claim 1 wherein raw hides are treated, prior to liming, with 0.05 to 0.50% by weight of a proteolytic enzyme with an Anson-activity of 1.2 to 1.5 in a bath of a temperature not exceeding 35° C. and a pH value not exceeding 12, and wherein the hides are subjected to hair-destruction liming with a lime liquor containing not more than 2.0% by weight of disodium sulfide, sodium hydrogen sulfide or both , calculated for the weight of the raw hide, then 50 to 150% by volume of 20° C. water and at least 0.04% by weight of manganese sulfate are added to the used lime liquor in the presence of the limed hides directly in the liming vessel, the hides are rotated for at least 15 minutes, thereafter up to 1.0% by weight of hydrogen peroxide is added in three portions at intervals of 10 minutes, to the liquor within an additional rotation period not exceeding 150 minutes.

6. A method as claimed in claim 4, characterized in that after decanting the bath the pig hide is grimped in a drum for 20 to 60 minutes and then the bristle is recovered and removed.

7. A method as claimed in claim 5, characterized in that after decanting the bath the hide is grimped in a drum for 20 to 60 minutes and then the hair is recovered and removed.

8. A method as claimed in claim 4, characterized in that after the removal of the bristle the bristle residues on the hide are destroyed in a drum, an Y-equipment or a mixer-type apparatus with 0.3 to 2.0% by wight of disodium sulfide calculated for the weight of the hide.

9. A method as claimed in claim 5, characterized in that after the removal of the hair the hair residues on the hide are destroyed in a drum, an Y-equipment or a mixer-type apparatus with 0.3 to 2.0% by weight of disodium sulfide calculated for the weight of the hide.

10. A method as claimed in claim 4 or 5, characterized in that the hide is treated in a lime reel, and the disodium sulfide concentration of the lime liquor is adjusted to the required value with 5–10 g/l of 60% disodium sulfide.

11. A method as claimed in claim 5, characterized in that at the end of liming the sulfide content of the used liquor and the pelt is oxidized directly in the liming vessel with 0.1–1.0% by weight of hydrogen peroxide calculated for the weight of the hide.

12. A method as claimed in claim 11, characterized in that oxidation is performed in a lime liquor containing 20 to 200 mg/l of manganese sulfate, and manganese sulfate is added to the hides in the used lime liquor prior to the introduction of hydrogen peroxide.

* * * * *